US006985125B2

(12) United States Patent
Velayudhan et al.

(10) Patent No.: US 6,985,125 B2
(45) Date of Patent: Jan. 10, 2006

(54) ADDRESSING OF AC PLASMA DISPLAY

(75) Inventors: Bala K Velayudhan, Kuala Lumpur (MY); Carol A. Wedding, Toledo, OH (US); Jeffrey W. Guy, Toledo, OH (US)

(73) Assignee: Imaging Systems Technology, Inc., Toledo, OH (US)

( * ) Notice: Subject to any disclaimer, the term of this patent is extended or adjusted under 35 U.S.C. 154(b) by 430 days.

(21) Appl. No.: 09/878,953

(22) Filed: Jun. 13, 2001

(65) Prior Publication Data

US 2001/0038366 A1 Nov. 8, 2001

Related U.S. Application Data

(63) Continuation-in-part of application No. 09/774,055, filed on Jan. 31, 2001, now abandoned, which is a continuation-in-part of application No. 09/643,843, filed on Aug. 23, 2000, now abandoned, which is a continuation-in-part of application No. 09/556,337, filed on Apr. 24, 2000, now abandoned.

(60) Provisional application No. 60/131,177, filed on Apr. 26, 1999.

(51) Int. Cl.
*G09G 3/28* (2006.01)
*G09G 3/10* (2006.01)

(52) U.S. Cl. ..... 345/60; 345/62; 315/69.4

(58) Field of Classification Search ..... 345/60–72; 315/169.4

See application file for complete search history.

(56) References Cited

U.S. PATENT DOCUMENTS

| | | | | |
|---|---|---|---|---|
| 3,499,167 A | | 3/1970 | Baker et al. | 315/169 |
| 3,559,190 A | | 1/1971 | Bitzer et al. | 340/173 |
| 3,603,836 A | | 9/1971 | Grier | 313/201 |
| 3,801,861 A | | 4/1974 | Petty et al. | 315/169 TV |
| 3,803,449 A | | 4/1974 | Schmersal | 315/169 TV |
| 4,063,131 A | | 12/1977 | Miller | 315/169 TV |
| 4,087,805 A | | 5/1978 | Miller | 340/324 M |
| 4,087,807 A | | 5/1978 | Miavecz | 340/324 M |
| 4,233,623 A | | 11/1980 | Pavliscak | 358/59 |
| 4,320,418 A | | 3/1982 | Pavliscak | 358/240 |
| 4,611,203 A | | 9/1986 | Criscimagna et al. | 340/773 |
| 4,683,470 A | | 7/1987 | Criscimagna et al. | 340/771 |
| 5,410,219 A | * | 4/1995 | Takei et al. | 315/169.4 |
| 5,436,634 A | * | 7/1995 | Kanazawa | 345/67 |
| 5,446,344 A | | 8/1995 | Kanazawa | 315/169.4 |
| 5,541,618 A | | 7/1996 | Shinoda | 345/60 |
| 5,661,500 A | | 8/1997 | Shinoda et al. | 345/60 |
| 5,674,553 A | | 10/1997 | Shinoda et al. | 427/68 |

(Continued)

FOREIGN PATENT DOCUMENTS

EP 1 020 838 A1 7/2000

(Continued)

OTHER PUBLICATIONS

J. Ryeom et al, High-Luminance and High-Contrast HDTV PDP with Overlapping Driving Scheme, pp. 743 to 746, *Proceedings of the Sixth International Display Workshops*, IDW 99, Dec. 1-3, 1999, Sendai, Japan.

(Continued)

*Primary Examiner*—Xiao Wu
*Assistant Examiner*—M. Fatahiyar
(74) *Attorney, Agent, or Firm*—Donald K. Wedding; Jim Zegeer

(57) ABSTRACT

Addressing and sustaining of a surface discharge AC plasma display panel by applying addressing voltages to at least one section of the panel while at least one other section of the panel is being simultaneously sustained.

12 Claims, 5 Drawing Sheets

1 SUSTAIN PHASE
2 PRIMING PHASE FOR RAMP RESET
3 UP RAMP RESET
K - IDLE TIME BEFORE NEGATIVE RAMP RESET
4 DOWN RAMP RESET
I - IDLE TIME BEFORE ADDRESSING
5 ADDRESSING
J - IDLE TIME BEFORE SUSTAINING
6 SUSTAIN PHASE

U.S. PATENT DOCUMENTS

| | | | | |
|---|---|---|---|---|
| 5,724,054 | A | 3/1998 | Shinoda | 345/60 |
| 5,736,815 | A | 4/1998 | Amemiya | 313/586 |
| 5,745,086 | A | 4/1998 | Weber | 345/63 |
| 5,793,158 | A | 8/1998 | Wedding, Sr. | 313/483 |
| 5,828,356 | A | 10/1998 | Stoller | 345/60 |
| 5,903,245 | A * | 5/1999 | Shimizu et al. | 345/60 |
| 5,914,563 | A | 6/1999 | Lee et al. | 206/750 |
| 6,034,657 | A | 3/2000 | Tokunaga et al. | 345/60 |
| 6,097,358 | A | 8/2000 | Hirakawa et al. | 345/63 |
| 6,198,476 | B1 | 3/2001 | Hong et al. | 345/204 |
| 6,208,081 | B1 | 3/2001 | Eo et al. | 315/169.1 |
| 6,252,574 | B1 * | 6/2001 | Hosoi et al. | 345/103 |
| 6,262,699 | B1 * | 7/2001 | Suzuki et al. | 345/68 |
| 6,288,693 | B1 * | 9/2001 | Song et al. | 345/68 |

FOREIGN PATENT DOCUMENTS

| | | |
|---|---|---|
| WO | WO 00/30065 | 5/2000 |

OTHER PUBLICATIONS

Kanazawa et al, *1999 Digest of the Society for Information Display*, pp. 154 to 157.

Tokunaga et al, Development of New Driving Method for AC-PCPs, *Pioneer Proceedings of the Sixth International Display Workshops*, IDW 99, pp. 787-790, Dec. 1-3, 1999, Sendai, Japan.

* cited by examiner

1 SUSTAIN PHASE

2 PRIMING PHASE FOR RAMP RESET

3 UP RAMP RESET

K - IDLE TIME BEFORE NEGATIVE RAMP RESET

4 DOWN RAMP RESET

I - IDLE TIME BEFORE ADDRESSING

5 ADDRESSING

J - IDLE TIME BEFORE SUSTAINING

6 SUSTAIN PHASE

ADDRESSING OF AC PLASMA DISPLAY

RELATED APPLICATIONS

This is a continuation in part under 35 USC 120 of a U.S. patent application Ser. No. 09/774,055 filed Jan. 31, 2001 now abandoned which is a continuation in part under 35 USC 120 of a U.S. patent application Ser. No. 09/643,843 filed Aug. 23, 2000 now abandoned which is a continuation in part under 35 USC 120 of U.S. patent application Ser. No. 09/556,337 filed Apr. 24, 2000 now abandoned which claims priority under 35 USC 119 (e) of Provisional Application 60/131,177 filed Apr. 26, 1999.

INTRODUCTION

This invention relates to the addressing and sustaining of an AC gas discharge plasma display panel (PDP) that uses a surface discharge structure. This invention comprises a method of operating an AC plasma display by applying selective write and/or selective erase voltages to at least one display section of a surface discharge PDP while at least one other display section of the PDP is being simultaneously sustained. This invention of Simultaneous Address and Sustain (SAS) is suitable for high resolution and high-information content AC plasma displays, including high definition television (HDTV).

BACKGROUND

The PDP industry has used two different AC plasma display panel (PDP) structures, the two-electrode columnar discharge structure and the three-electrode surface discharge structure. The two-electrode columnar discharge display structure is disclosed in U.S. Pat. No. 3,499,167 issued to Baker et al and U.S. Pat. No. 3,559,190 issued to Bitzer et al. The two-electrode columnar discharge structure is also referred to as opposing electrode discharge, twin substrate discharge, or co-planar discharge. In the two-electrode columnar discharge AC plasma display structure, the sustaining voltage is continuously applied between an electrode on a rear or bottom substrate and an opposite electrode on the front or top viewing substrate. The gas discharge takes place between the two opposing electrodes in between the top viewing substrate and the bottom substrate.

The columnar discharge structure has been widely used in monochrome AC plasma displays that emit orange or red light from a neon gas discharge. Typically phosphors are not used in such monochrome structures.

The present invention relates to a surface discharge AC plasma display panel having a structure with three or more electrodes defining each pixel or cell. In a three-electrode surface discharge AC plasma display, a sustaining voltage is applied between a pair of adjacent parallel electrodes that are on the front or top viewing substrate. These parallel electrodes are called the bulk sustain electrode and the row scan electrode. The row scan electrode is also called a row sustain electrode because of its dual functions of address and sustain. The opposing electrode on the rear or bottom substrate is a column data electrode and is used to periodically address a row scan electrode on the top substrate. The sustaining voltage is applied to the bulk sustain and row scan electrodes on the top substrate. The gas discharge takes place between the row scan and bulk sustain electrodes on the top viewing substrate.

As disclosed and illustrated in Baker 167, the two-electrode columnar discharge AC plasma display panel is an opposite discharge display with the sustaining voltage being applied to the two opposite top and bottom electrodes. The discharge takes place between these two opposing electrodes and in between the opposing top and bottom substrates. In a multi-color columnar discharge (PDP) structure as disclosed in U.S. Pat. No. 5,793,158 issued to Wedding, phosphor stripes or layers are deposited along the barrier walls on the bottom substrate adjacent to and extending in the same direction as the bottom electrode. The discharge between the two opposite electrodes generates electrons and ions that bombard and deteriorate the phosphor thereby shortening the life of the phosphor and the PDP.

In contrast, in a three-electrode surface discharge AC plasma display panel, the sustaining voltage and resulting gas discharge occurs between the electrode pairs on the top or front viewing substrate above and remote from the phosphor on the bottom substrate. This separation of the discharge from the phosphor prevents electron bombardment and deterioration of the phosphor deposited on the walls of the barriers or in the grooves (or channels) on the bottom substrate adjacent to and/or over the third (data) electrode. Because the phosphor is spaced from the discharge between the two electrodes on the top substrate, the phosphor is not subject to electron bombardment as in a columnar discharge PDP.

In a surface discharge PDP, each light emitting pixel or cell is defined by the gas discharge between two electrodes on the top substrate. In a multi-color RGB display, the pixels may be called sub-pixels or sub-cells. Photons from the discharge of an ionizable gas at each pixel or sub-pixel excite a photoluminescent phosphor that emits red, blue, or green light.

In a two electrode columnar discharge PDP as disclosed by Wedding 158, each light emitting pixel is defined by a gas discharge between a bottom or rear electrode x and a top or front opposite electrode y, each cross-over of the two opposing arrays of bottom electrodes x and top electrodes y defining a pixel or cell.

The three-electrode multi-color surface discharge AC plasma panel structure is widely disclosed in the prior art including U.S. Pat. Nos. 5,661,500 and 5,674,553, both issued to Tsutae Shinoda et al of Fujitsu Limited; U.S. Pat. No. 5,745,086 issued to Larry F. Weber of Plasmaco and Matsushita; and U.S. Pat. No. 5,736,815 issued to Kimio Amemiya of Pioneer Electronic Corporation, all of which are incorporated herein by reference.

For reasons discussed above and also as presented in TABLE I hereafter, the multi-color columnar discharge PDP with phosphors has not been successfully commercialized in the PDP industry. However, the multi-color surface discharge PDP has been successfully commercialized and is presently been widely manufactured by a number of firms.

TABLE I presents a comparison and overview of the two-electrode multi-color columnar discharge PDP structure versus the three-electrode multi-color surface discharge PDP structure at a sustain frequency of 30 kHz and a gas mixture containing less than 6% xenon.

TABLE I

AC PLASMA DISPLAY STRUCTURES
COLUMNAR DISCHARGE vs SURFACE DISCHARGE

| Attribute | Columnar Discharge | Surface Discharge |
|---|---|---|
| Number of Electrodes | 2 | 3 |
| Phosphor Deposition | Unforgiving: Phosphor | Forgiving: Phosphor |

TABLE I-continued

AC PLASMA DISPLAY STRUCTURES
COLUMNAR DISCHARGE vs SURFACE DISCHARGE

| Attribute | Columnar Discharge | Surface Discharge |
|---|---|---|
| | cannot cover electrode at discharge sites on the bottom substrate. Will decrease life of phosphor and panel | entirely covers the electrode on the bottom substrate. Will not decrease life of phosphor and panel |
| Number of Bits per Color | | |
| @ 640 × 480 resolution | 8 bits | 8 bits |
| @ 1280 × 1240 pixels | 6 bits | 8 bits |
| Display Colors @ 1280 × 024 pixels | 262,144 | 16,777,216 |
| Luminance FL @ 30 KHz sustain | <20 | >60 |
| Power, Watts @ 30 KHz sustain | | |
| 19–21" diagonal 640 × 480 pixels | 150–200 W | 110 W |
| 19–21" diagonal 1280 × 1024 pixels | 200 W | |
| 25" diagonal 1280 × 1024 pixels | 220 W | 200 W |
| 30" diagonal 1024 × 768 pixels | 350–400 W | |
| 42" diagonal 856 × 480 pixels | | 350 W |
| Luminous Efficiency, Lumens per Watt, at 30 KHz sustain | 0.05 to 0.4 | 1.0 to 1.5 |
| Operating Life in Hours @ 30 KHz sustain and 20% fill factor | <2000 | >10,000 |
| Contrast Ratio | <20:1 | >100:1 |
| Peak Discharge Current | 4 times Surface Peak Discharge | |
| EMI | Much higher because of high peak discharge current | |

As summarized in TABLE I, the three-electrode surface discharge PDP superiority over the two-electrode columnar discharge PDP includes lower power, longer life, greater contrast, lower peak discharge current, higher luminance (brightness), and higher luminous efficiency. The high peak discharge current of columnar discharge greatly adds to the costs of the electronic circuitry.

Surface discharge also has manufacturing advantages over columnar discharge. One of these (phosphor deposition) is listed in TABLE I. The deposition of phosphor in the manufacture of surface discharge is very forgiving because the phosphor covers the electrodes on the back (bottom) substrate without decreasing panel life.

In a columnar discharge structure, the phosphor must be precisely deposited and cannot cover electrode discharge sites on the back substrate without further decreasing phosphor life. There is little or no forgiveness in deposition of the phosphor. It may also be necessary to use an overcoat such as magnesium oxide to protect the phosphor from discharge ion bombardment. However, a protective overcoat decreases light output from the phosphor. A protective phosphor overcoat is not used or required in the manufacture of a surface discharge display structure.

The surface discharge PDP structure is also much less sensitive than columnar discharge to variations in the gas discharge gap between the back and front substrates. In a columnar discharge PDP structure, the gap must be precisely controlled to avoid variations and distortions in luminance and chromaticity.

Prior Art Addressing of Two-Electrode Multi-Color Columnar Discharge Structure In Stoller U.S. Pat. No. 5,828,356, there is disclosed an addressing scheme for an opposite discharge two-electrode multi-color columnar discharge panel structure with an array of bottom electrodes x and an array of top opposite electrodes y, the crossover of each bottom x electrode and each top y electrode defining a pixel. The sustaining voltage is applied to the opposite bottom electrode x and top electrode y with the gas discharge taking place between the electrodes x and y. Stoller uses the same electronic architecture as used in the prior art for monochromatic columnar discharge PDP.

Prior Art Addressing of Multi-Color Surface Discharge Structure

A basic electronics architecture for addressing and sustaining a surface discharge AC plasma display is called Address Display Separately (ADS). The ADS architecture is disclosed in a number of Fujitsu patents including U.S. Pat. Nos. 5,541,618 and 5,724,054, both issued to Shinoda of Fujitsu Ltd., Kawasaki, Japan. Also see U.S. Pat. No. 5,446,344 issued to Yoshikazu Kanazawa of Fujitsu and Shinoda et al 500 referenced above. ADS has become a basic electronic architecture widely used in the AC plasma display industry.

Fujitsu ADS architecture is commercially used by Fujitsu and is also widely used by competing manufacturers including Matsushita and others. ADS is disclosed in U.S. Pat. No. 5,745,086 issued to Weber of Plasmaco and Matsushita. See FIGS. 2, 3, 11 of Weber 086. The ADS method of addressing and sustaining a surface discharge display as disclosed in U.S. Pat. Nos. 5,541,618 and 5,724,054 issued to Shinoda of Fujitsu sustains the entire panel (all rows) after the addressing of the entire panel. Thus the addressing and sustaining are done separately and are not done simultaneously as in the practice of this invention.

Another architecture used in the prior art is called Address While Display (AWD). The AWD electronics architecture was first used during the 1970s and 1980s for addressing and sustaining monochrome PDP. In AWD architecture, the addressing (write and/or erase pulses) are interspersed with the sustain waveform and may include the incorporation of address pulses onto the sustain waveform. Such address pulses may be on top of the sustain and/or on a sustain notch or pedestal. See for example U.S. Pat. No. 3,801,861 issued to Petty et al and U.S. Pat. No. 3,803,449 issued to Schmersal. FIGS. 1 and 3 of the Shinoda 054 ADS patent discloses AWD architecture as prior art.

The prior art AWD electronics architecture for addressing and sustaining monochrome PDP has also been adopted for addressing and sustaining multi-color PDP. For example, Samsung Display Devices Co., Ltd., has disclosed AWD and the superimpose of address pulses with the sustain pulse. Samsung specifically labels this as address while display (AWD). See High-Luminance and High-Contrast HDTV PDP with Overlapping Driving Scheme, J. Ryeom et al, pages 743 to 746, Proceedings of the Sixth International Display Workshops, IDW 99, Dec. 1–3, 1999, Sendai, Japan. AWD is also disclosed in U.S. Pat. No. 6,208,081 issued to Yoon-Phil Eo and Jeong-duk Ryeom of Samsung.

LG Electronics Inc. has disclosed a variation of AWD with a Multiple Addressing in a Single Sustain (MASS) in U.S. Pat. No. 6,198,476 issued to Jin-Won Hong et al of LG Electronics. Also see U.S. Pat. No. 5,914,563 issued to Eun-Cheol Lee et al of LG Electronics.

The present SAS invention offers a unique electronic architecture which is different from prior art columnar discharge and surface discharge electronics architectures including ADS, AWD, and MASS and offers important advantages as discussed herein.

Addressing of Surface Discharge Structure in Accordance with this Invention

The present SAS invention comprises addressing one display section of a surface discharge PDP while another section of the PDP is being simultaneously sustained. This architecture is called Simultaneous Address and Sustain (SAS).

In accordance with the practice of this SAS invention, addressing voltage waveforms are applied to a surface discharge AC plasma display having an array of data electrodes on a bottom or rear substrate and an array of at least two electrodes on a top or front viewing substrate, one top electrode being a bulk sustain electrode x and the other top electrode being a row scan electrode y. The row scan electrode y may also be called a row sustain electrode because it performs the dual functions of both addressing and sustaining.

An important feature and advantage of this invention is that it allows selectively addressing of one section of a surface discharge panel, for example with selective write and/or selective erase voltages while another section of the panel is being simultaneously sustained. A section is defined as a predetermined number of bulk sustain electrodes x and row scan electrodes y. In a surface discharge display, a single row is comprised of one pair of parallel top electrodes x and y.

In accordance with one embodiment of this SAS invention, there is provided the simultaneous addressing and sustaining of at least two sections $S_1$ and $S_2$ of a surface discharge PDP having a row scan, bulk sustain, and data electrodes, which comprises addressing one section $S_1$ of the PDP while a sustaining voltage is being simultaneously applied to at least one other section $S_2$ of the PDP.

In another embodiment hereof, the simultaneous addressing and sustaining is interlaced whereby one pair of electrodes y and x are addressed without being sustained and an adjacent pair of electrodes y and x are simultaneously sustained without being addressed. This interlacing can be repeated throughout the display. In this embodiment, a section S is defined as one or more pairs of interlaced y and x electrodes.

In the practice of this invention, the row scan and bulk sustain electrodes of one section that is being sustained may have a reference voltage which is offset from the voltages applied to the data electrodes for the addressing of another section such that the addressing does not electrically interact with the row scan and bulk sustain electrodes of the section which is being sustained.

In a plasma display in which gray scale is realized through time multiplexing, a frame or a field of picture data is divided into subfields. Each subfield is typically composed of a reset period, an addressing period, and a number of sustains. The number of sustains in a subfield corresponds to a specific gray scale weight. Pixels that are selected to be "on" in a given subfield will be illuminated proportionally to the number of sustains in the subfield. In the course of one frame, pixels may be selected to be "on" or "off" for the various subfields. A gray scale image is realized by integrating in time the various "on" and "of" pixels of each of the subfields.

Addressing is the selective application of data to individual pixels. It includes the writing or erasing of individual pixels.

Reset is a voltage pulse which forms wall charges to enhance the addressing of a pixel. It can be of various waveform shapes and voltage amplitudes including fast or slow rise time voltage ramps and exponential voltage pulses. A reset is typically used at the start of a frame before the addressing of a section. A reset may also be used before the addressing period of a subsequent subfield.

In accordance with a further embodiment of this SAS invention, there is applied a slow rise time or slow ramp reset voltage. As used herein "slow rise time or slow ramp voltage" is a bulk address commonly called a reset pulse with a positive or negative slope so as to provide a uniform wall charge at all pixels in the PDP.

The slower the rise time of the reset ramp, the less visible the light or background glow from those off-pixels (not in the on-state) during the slow ramp bulk address.

Less background glow is particularly desirable for increasing the contrast ratio which is inversely proportional to the light-out from the off pixels during the reset pulse. Those off-pixels which are not in the on-state will give a background glow during the reset. The slower the ramp, the less light output with a resulting higher contrast ratio. Typically the "slow ramp reset voltages" disclosed in the prior art have a slope of about 3.5 volts per microsecond with a range of about 2 to about 9 volts per microsecond.

In the practice of this invention, it is possible to use "slow ramp reset voltages" below 2 volts per microsecond, for example about 1 to 1.5 volts per microsecond without decreasing the number of PDP rows, without decreasing the number of sustain pulses or without decreasing the number of subfields.

Slow Ramp Reset Voltage

The prior art discloses slow rise slopes or ramps for the addressing of AC plasma displays. The early patents include U.S. Pat. Nos. 4,063,131 and 4,087,805 issued to John Miller of Owens-Ill.; U.S. Pat. No. 4,087,807 issued to Joseph Miavecz of Owens-Ill.; and U.S. Pat. Nos. 4,611,203 and 4,683,470 issued to Tony Criscimagna et al of IBM.

An architecture for a slow ramp reset voltage is disclosed in U.S. Pat. No. 5,745,086 issued to Larry F. Weber of Plasmaco and Matsushita. Weber 086 discloses positive or negative ramp voltages that exhibit a slope that is set to assure that current flow through each display pixel site remains in a positive resistance region of the gas discharge characteristics. The slow ramp architecture is disclosed in FIG. 11 of Weber 086 in combination with the Fujitsu ADS.

PCT Patent Application WO 00/30065 filed by Junichi Hibino et al of Matsushita also discloses architecture for a slow ramp reset voltage. Habino et al specifies a total ramp reset cycle time restricted to less than 360 microseconds for a display panel resolution up to 1080 row scan electrodes with a maximum of 8 subfields using dual scan. With dual scan, Habino et al can obtain up to 15 subfields for lower resolution displays such as 480 and 768 row scan electrodes.

The present SAS invention allows for a ramp reset cycle time up to 1000 microseconds (one millisecond) or more depending upon the display panel resolution. For a display panel resolution of 1080 row scan electrodes, the SAS invention allows for a ramp reset cycle time up to 800 microseconds without decreasing the number of sustains and/or sub fields as required in the prior art.

For lower panel scan row resolutions of 480 and 768, this SAS invention allows a ramp reset cycle time up to 1000 microseconds.

Habino et al specifies a reset voltage rise slope of no more than 9 volts per microsecond. Because the entire reset cycle time of Habino et al. is a maximum of 360 microseconds, it is not feasible for Habino et al to use a reset ramp slope of 1.5 volts per microsecond without also decreasing the maximum or peak voltage amplitude of the reset voltage below the amplitude required for reliable discharge and stable addressing. The practice of the present SAS invention allows for the use of a reset ramp slope of 1 to 1.5 volts per microsecond at the maximum reset voltage amplitude required for reliable discharge and stable addressing.

The practice of this present SAS method and invention also allows the use of a low reset voltage rise slope of about 1 to 1.5 volts per microsecond with an overall ramp reset cycle time up to 1000 microseconds.

In one embodiment of this invention there is used a ramp reset cycle time of 800 microseconds, a display resolution of 1080 row scan electrodes, and a reset voltage rise slope of 1 to 1.5 volts per micro second.

The resolutions typically contemplated in the practice of this invention are 480, 600, 768, 1024, 1080, and 1200 row scan electrodes which are currently used in the PDP industry. However, other resolutions may be used.

Advantages of SAS

SAS allows for simultaneous addressing and sustaining thereby providing more time within the frame for other waveform operations. By comparison the ADS architecture of Fujitsu allocates 75 percent of the frame time for addressing and 25 percent for sustaining.

Because both the addressing and sustaining are completed in 75 percent of the available frame time, SAS has 25% remaining frame time.

SAS has the ability to do 12 to 17 sub-fields for panel resolutions up to 768 row scan electrodes and 10 to 12 sub-fields for resolutions of 1080 row scan electrodes without using dual scan.

As noted above slow reset ramp can also be used with SAS. The slow ramp reset can be tailored to ramp slopes of 1.5 microseconds per volt or less which greatly minimizes background glow. This is not possible with the ADS approach of Fujitsu. SAS also provides for a more uniform contrast ratio, better wall charge profile and improved addressing stability.

Dual Scan

In the practice of this invention the PDP may be physically divided into at least two sections with each section being addressed by separate electronics. This was first disclosed in U.S. Pat. Nos. 4,233,623 and 4,320,418 issued to Dr. Thomas J. Pavliscak. It is also disclosed in U.S. Pat. No. 5,914,563 issued to Eun-Cheol Lee et al of LG Electronics.

In the PDP industry this dividing of the PDP into two sections with separate electronics for each section is called dual scan. It is more costly to use dual scan because of the added electronics and reduced PDP yield. However, dual scan has been necessary with ADS and AWD architecture in order to obtain sufficient sub-fields at higher resolutions. The practice of this SAS invention allows for a larger number of sub-fields at higher resolutions without using dual scan.

SAS maintains higher probability of priming particles due to its virtual "dual-scan" like operation.

Coupled with improved priming and uniform wall charge distribution, SAS allows for the addressing of high resolution AC plasma displays with 10 to 12 sub-fields at a high resolution of 1080 row scan electrodes without dual scan.

DETAILED DESCRIPTION OF THE DRAWINGS AND EMBODIMENTS OF INVENTION

Figure 1:
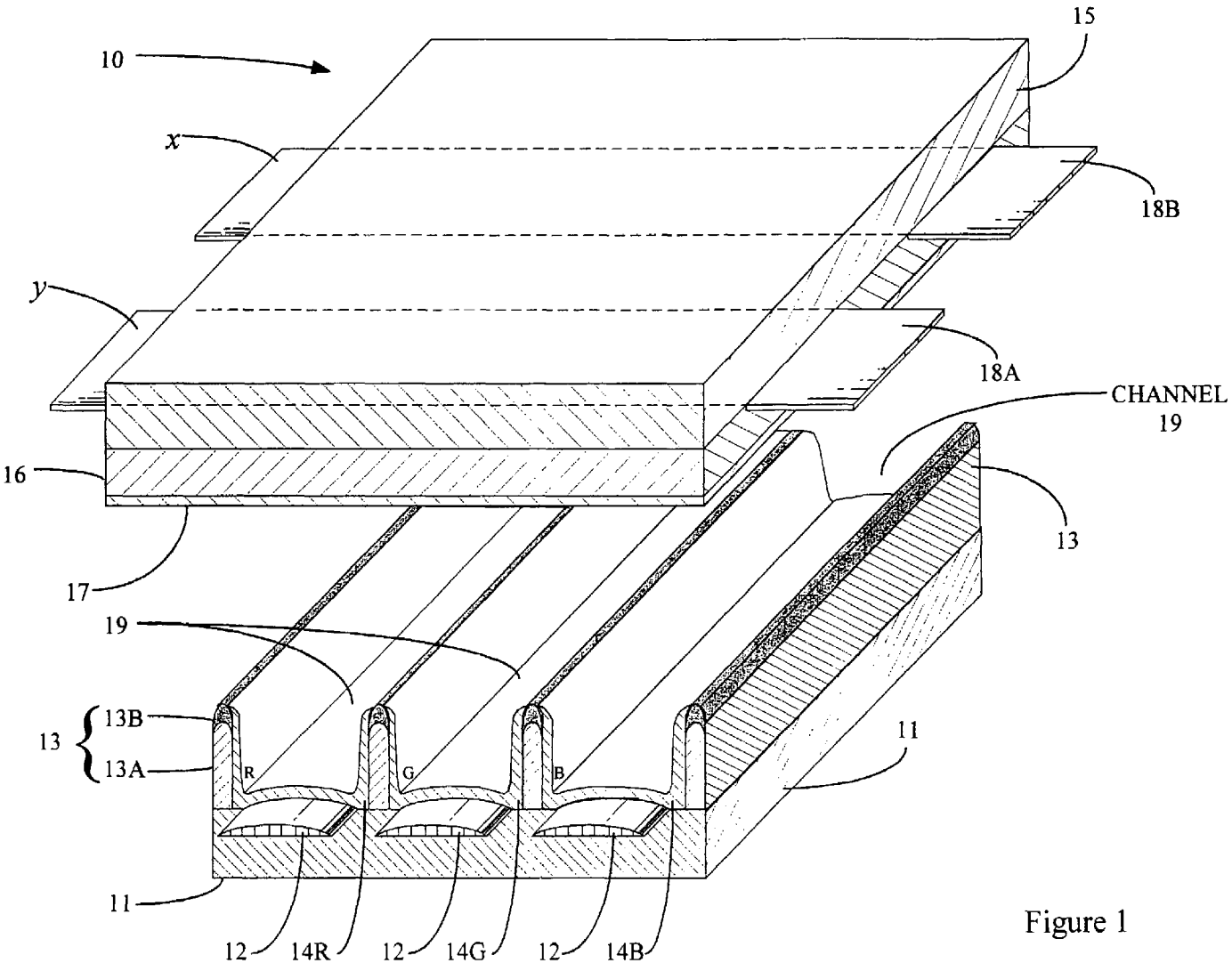
FIG. 1 shows a prospective view of an AC gas discharge plasma display panel (PDP) with a surface discharge structure.
Figure 2:
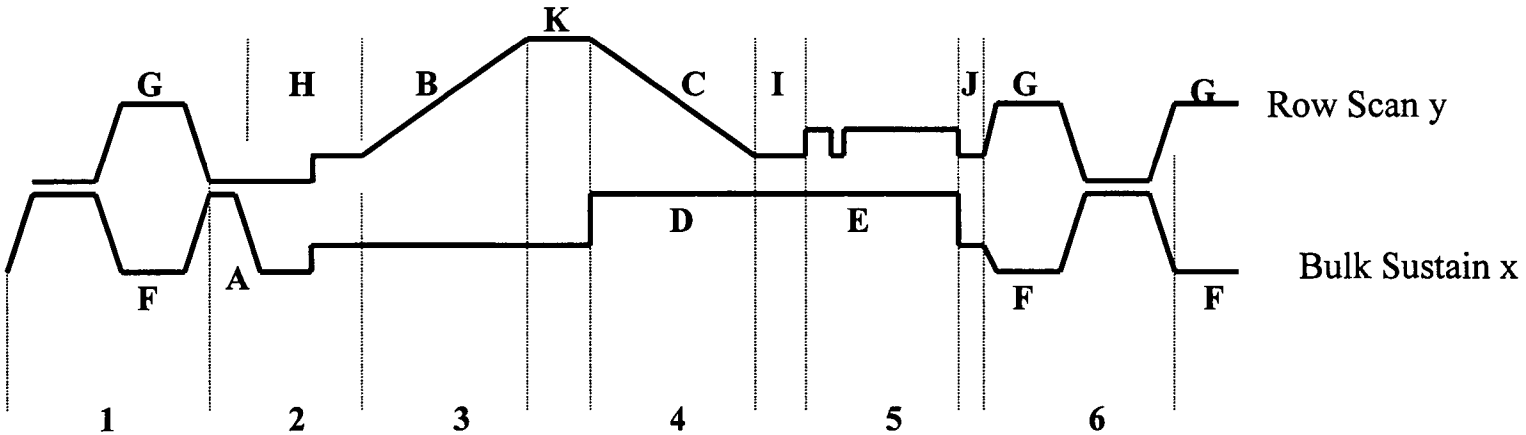
FIG. 2 shows a Simultaneous Address and Sustain (SAS) waveform.

FIG. 1 shows an AC gas discharge plasma display panel with a surface discharge structure 10 similar to the surface discharge structure illustrated and described in FIG. 2 of U.S. Pat. No. 5,661,500 (Shinoda et al.) which is cited above and incorporated herein by reference. The panel structure 10 has a bottom or rear glass substrate 11 with column data electrodes 12, barriers 13, and phosphor 14R, 14G, 14B.

Each barrier 13 comprises a bottom portion 13A and a top portion 13B. The top portion 13B is dark or black for increased contrast ratio. The bottom portion 13A may be translucent, opaque, dark, or black.

The top substrate 15 is transparent glass for viewing and contains y row scan (or sustain) electrodes 18A and x bulk sustain electrodes 18B, dielectric layer 16 covering the electrodes 18A and 18B, and a magnesium oxide layer 17 on the surface of dielectric 16. The magnesium oxide is for secondary electron emission and helps lower the overall operating voltage of the display.

A plurality of channels 19 are formed by the barriers 13 containing the phosphor 14. When the two substrates 11 and 15 are sealed together, an ionizable gas mixture is introduced into the channels 19. This is typically a Penning mixture of the rare gases. Such gases are well known in the manufacture and operation of gas discharge displays.

As noted above, each electrode 12 on the bottom substrate 11 is called a column data electrode. The y electrode 18A on the top substrate 15 is the row scan (or sustain) electrode and the x electrode 18B on the top substrate 15 is the bulk sustain electrode. A pixel or sub-pixel is defined by the three electrodes 12, 18A, and 18B. The gas discharge is initiated by voltages applied between a bottom column data electrode 12 and a top y row scan electrode 18A. The sustaining of the resulting discharge is done between an electrode pair of the top y row scan electrode 18A and a top x bulk sustain electrode 18B. Each pair of the y and x electrodes is a row.

Phosphor 14R emits red luminance when excited by photons from the gas discharge within the plasma panel. Phosphor 14G emits green luminance when excited by photons from the gas discharge within the plasma panel. Phosphor 14B emits blue luminance when excited by photons for the gas discharge within the plasma panel.

Although not illustrated in FIG. 1, the y row scan (or sustain) electrode 18A and the x bulk sustain electrode 18B may each be a transparent material such as tin oxide or indium tin oxide (ITO) with a conductive thin strip, ribbon or bus bar along one edge. The thin strip may be any conductive material including gold, silver, chrome-copper-chrome, or like material. Both pure metals and alloys may be used. This conductive strip is illustrated in FIG. 2 of Shinoda 500.

Split or divided electrodes connected by cross-overs may also be used for x and y for example as disclosed in U.S. Pat. No. 3,603,836 issued to John Grier. A split electrode structure may also be used for the column data electrodes.

The column data electrodes may be of different widths for each R, G, B phosphor as disclosed in U.S. Pat. No. 6,034,657 issued to Tokunaga et al of Pioneer.

The electrode arrays on either substrate are shown in FIG. 1 as orthogonal, but may be of any suitable pattern including zig-zag or serpentine.

Although the practice of this invention is described herein with each pixel or sub-pixel defined by a three-electrode surface discharge structure, it will be understood that this invention may also be used with surface discharge structures having more than three distinct electrodes, for example more than two distinct electrodes on the top substrate and/or more than one distinct electrode on the bottom substrate. In the literature, some surface discharge structures have been described with four or more electrodes including three or more electrodes on the front substrate.

The prior art has also described surface discharge structures where there is a sharing of electrodes between pixels or sub-pixels on the front substrate. Fujitsu has described this structure in a paper by Kanazawa et al published on pages 154 to 157 of the 1999 *Digest of the Society for Information Display*. Fujitsu calls this "Alternating Lighting on Surfaces" or ALIS. Fujitsu has used ALIS with ADS. Shared electrodes may be used is the practice of the present invention.

FIG. 2 shows a Simultaneous Address and Sustain (SAS) waveform for the practice of this invention with a surface discharge AC plasma display for example a PDP as illustrated in FIG. 1. FIG. 2 shows SAS waveforms with Phases 1, 2, 3, 4, 5, 6 for the top row scan electrode y and the top bulk sustain electrode x. In FIG. 2, the scan row electrode y corresponds to electrode 18A in FIG. 1. The bulk sustain electrode x corresponds to electrode 18B in FIG. 1.

Figure 3:
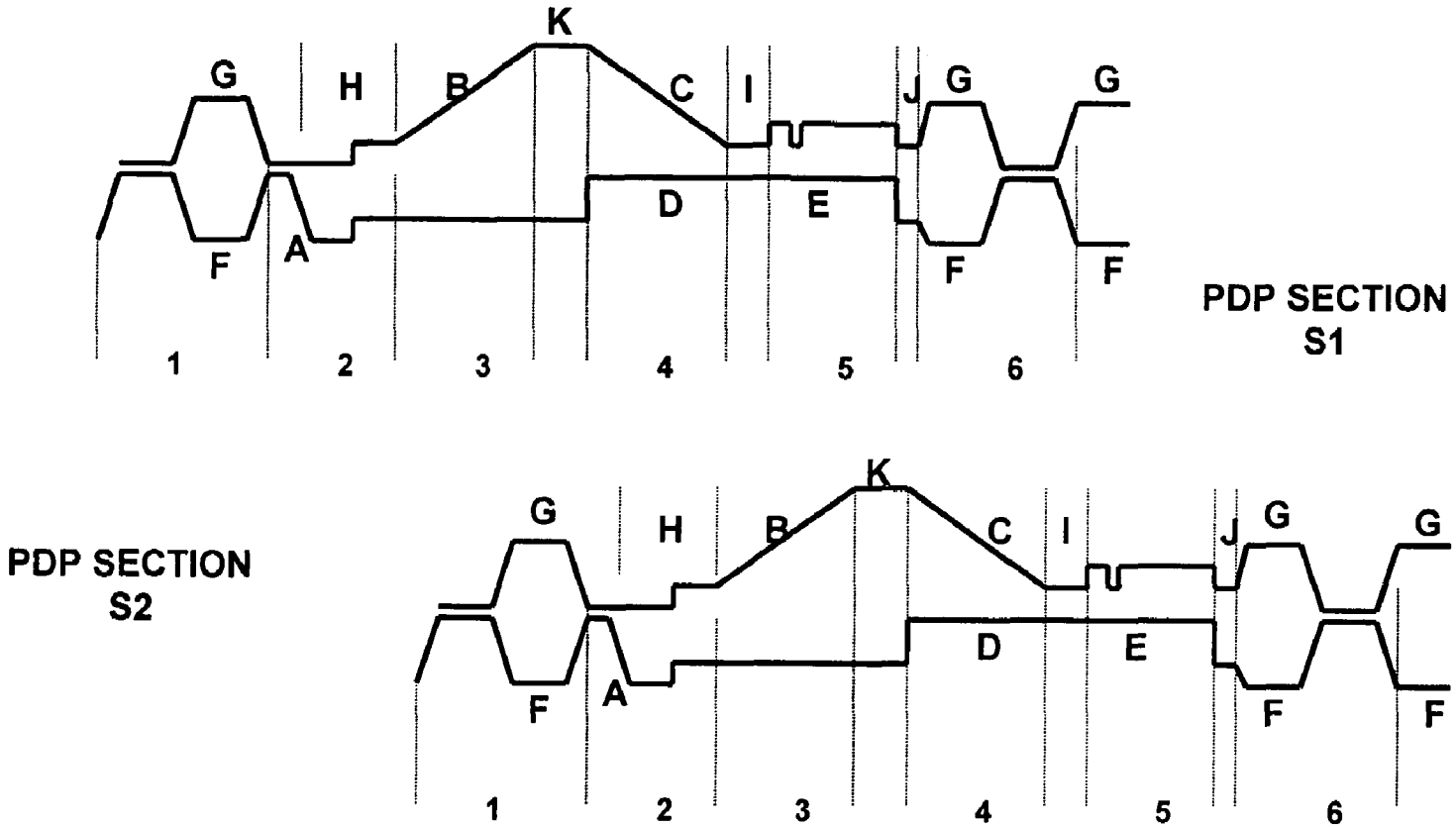
FIG. 3 shows an SAS waveform for simultaneous addressing and sustaining different sections $S_1$ and $S_2$ of a surface discharge PDP

In Phases 1 and 6 of FIG. 2 the sustaining pulse for the electrodes x and y is shown. The data electrode CD (element 12 in FIG. 1) is simultaneously addressing another section of the display as shown in FIG. 3 which is not being sustained. In the Fujitsu ADS architecture the bottom column data electrode CD is positively offset during sustain, and simultaneous operations are not allowed.

Phase 2 of FIG. 2 is the priming phase for the up ramp reset. A reset pulse conditions both the on and off pixels to the same wall charge. It provides a uniform wall charge to all pixels. A is a sustain pulse that is narrower in length than the previous sustain pulses. Its function is to sustain the on pixels and immediately extinguish them. It is sufficiently narrow (typically 1 microsecond or less) to prevent wall charges from accumulating. This narrow pulse causes a weak discharge and may be at higher voltages relative to other sustain pulses in the system. Alternately, a wider pulse with a lower voltage than "G" may be used.

As illustrated in FIG. 2, G is the highest and most positive amplitude of the sustain. F is the lowest and most negative amplitude of the sustain.

H is a period of time sufficient to allow the ramp to take advantage of the priming caused by the narrow sustain pulse and erase.

At the end of Phase 2 the row scan electrode y and bulk sustain electrode x go back to reference. This can also occur at the end of Phase 4 and the beginning of Phase 5, but such requires additional circuitry and adds to the cost of the system.

Phase 3 of FIG. 2 is the up ramp reset. Because of the SAS architecture, B can be made to ramp slower than prior art architecture (without implementing dual scan). This allows for uniform wall charge deposition. It also reduces background glow and increases the addressing voltage window. K is the idle time before negative ramp reset.

Phase 4 of FIG. 2 is the down ramp reset. If necessary, C and D may be combined to provide a weak discharge. If the up ramp B is slow enough, D may not be needed and C can have an RC slope, where R is the resistance of the electronic circuitry and C is the capacitance of the AC plasma display panel. A weak discharge caused by B or the combination of C and D will further insure a uniform wall charge profile for the various pixel or sub-pixel sites. I is the idle time before addressing.

Phase 5 of FIG. 2 shows the addressing of the row scan electrode y. The row addressing voltage is at an amplitude level sufficiently high to preserve the negative wall charge put on the pixel by the reset pulses of Phases 3 and 4. The row scan electrode y is selectively adjusted so that it may be selectively addressed by the bottom column data electrode CD. J is the idle time before sustaining.

The bulk sustain electrode x has a positive voltage applied throughout the addressing phase to induce charge transport between the pair of electrodes x and y which are sustained after the addressing discharge has taken place.

FIG. 3 shows the SAS waveform of FIG. 2 being used to address and sustain different Sections S1 and S2 of a surface discharge AC plasma display. The waveform for S1 is simultaneously addressing while the waveform for S2 is sustaining. Each waveform for the two Sections S1 and S2, is a repeat of the SAS waveform described in FIG. 2, but each is out of phase with respect to the other as illustrated in FIG. 3.

Figure 4:
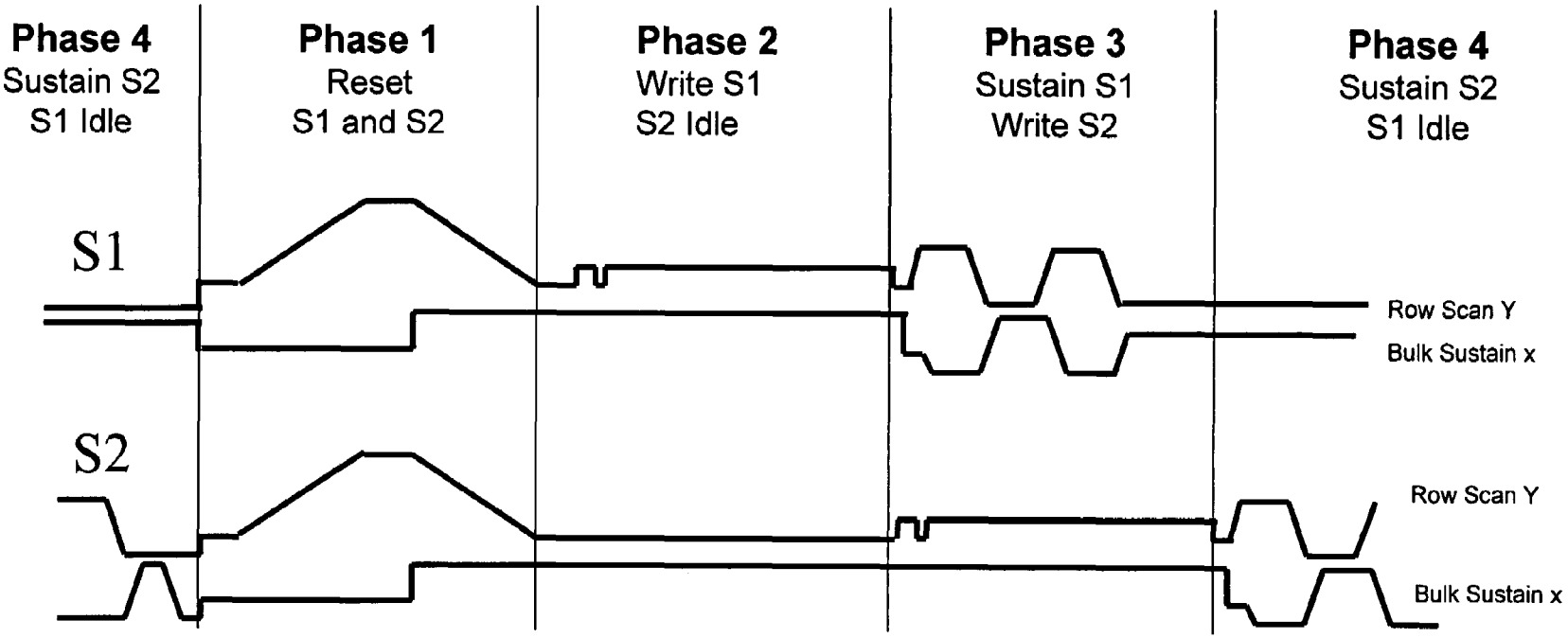
FIG. 4 shows another SAS waveform for simultaneous addressing and sustaining different sections $S_1$ and $S_2$ of a surface discharge PDP.

The waveform of FIG. 4 may also be used for addressing one section $S_1$ while another section $S_2$ is simultaneously being sustained. The sections $S_1$ and $S_2$ may be sustained with the same number of sustains per subfield or with a different number of sustains per subfield.

In Table II there is presented a 10 subfield example using the waveform of FIG. 4 with the same number of sustains in each subfield for Section 1 and Section 2.

TABLE II

| Subfield | 1 | 2 | 3 | 4 | 5 | 6 | 7 | 8 | 9 | 10 |
|---|---|---|---|---|---|---|---|---|---|---|
| # sustains $S_1$ | 96 | 96 | 96 | 96 | 64 | 32 | 16 | 8 | 4 | 2 |
| # sustains $S_2$ | 96 | 96 | 96 | 96 | 64 | 32 | 16 | 8 | 4 | 2 |

Table III shows one subfield within the frame.

TABLE III

| Subfield | 1 | | | |
|---|---|---|---|---|
| $S_1$ | Reset | Address | 96 Sustain | |
| $S_2$ | Reset | | Address | 96 Sustain |

Table IV shows 10 subfields with a different number of sustains in each subfield for $S_1$ and $S_2$

TABLE IV

| Subfield | 1 | 2 | 3 | 4 | 5 | 6 | 7 | 8 | 9 | 10 |
|---|---|---|---|---|---|---|---|---|---|---|
| # sustain $S_1$ | 96 | 96 | 96 | 96 | 64 | 32 | 16 | 8 | 4 | 2 |
| # sustain $S_2$ | 2 | 4 | 8 | 16 | 32 | 64 | 96 | 96 | 96 | 96 |

Table V shows one subfield within the frame.

TABLE V

| Subfield | 1 | | | |
|---|---|---|---|---|
| $S_1$ | Reset | Address | 96 Sustain | |
| $S_2$ | Reset | | Address | 2 Sustain |

In the case of different sustains being employed by $S_1$ and $S_2$, an additional advantage may be derived by changing the order in which $S_1$ and $S_2$ are addressed. Additional time savings may also be obtained if the section with the larger number of sustains is addressed in phase 2. This allows for a greatest amount of overlap to occur between sustaining and addressing in Phase 3. The result is more time available for ramped resets, additional sustains, additional subfields, and/or more rows.

Figure 5:
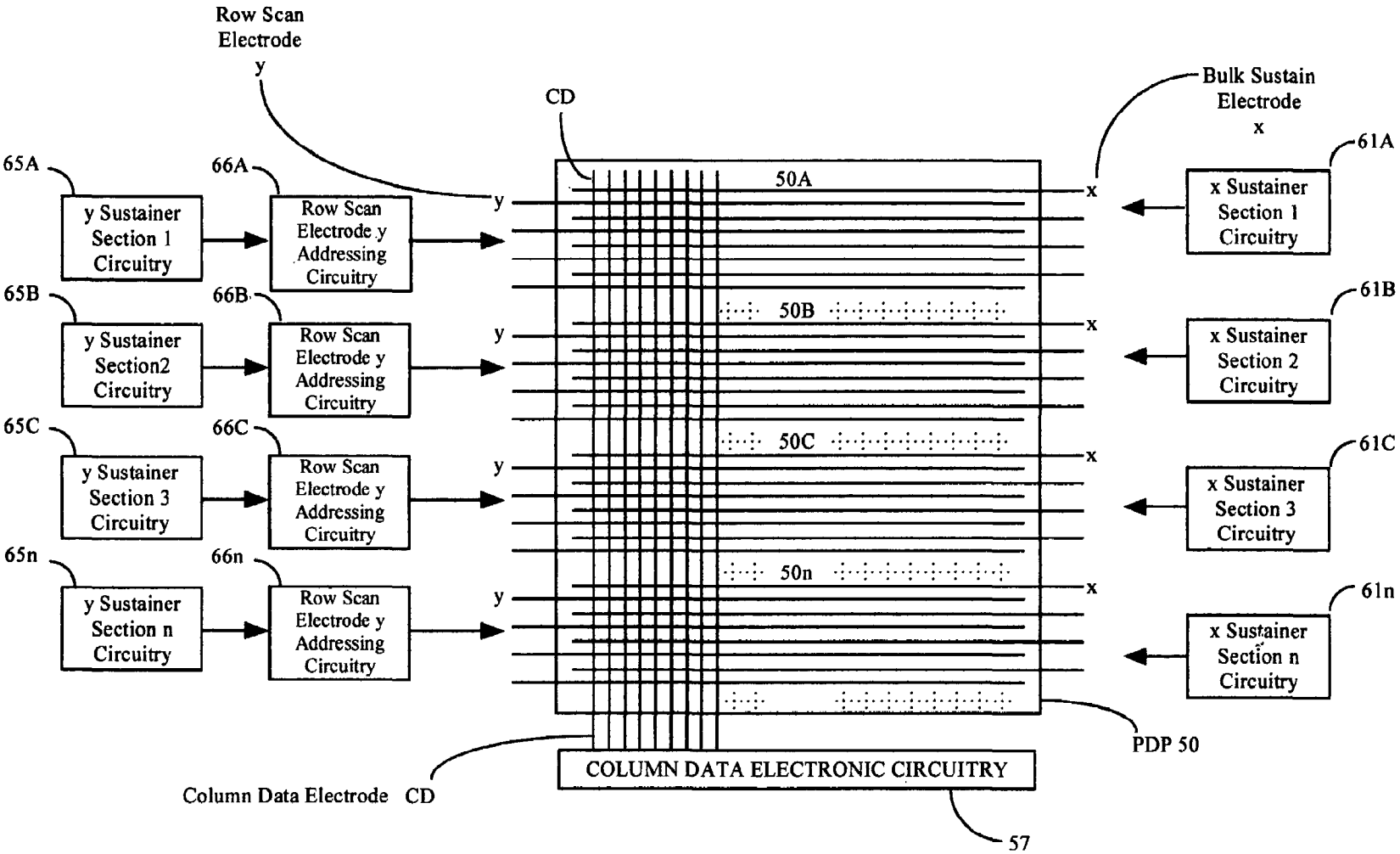
FIG. 5 shows an SAS electronic circuitry diagram for simultaneous address and a sustain of different sections of a surface discharge PDP.

The waveforms of FIGS. 2, 3, and 4 may be implemented with the Block Diagram Circuitry of FIG. 5.

FIG. 5 is an electronics circuitry block diagram for Simultaneous Address and Sustain (SAS) of a surface discharge AC plasma display such as shown in FIG. 1. This shows the practice of this invention on a surface discharge AC plasma display panel (PDP) 50 subdivided into n sections 50A, 50B, 50C, 50*n*. As shown in FIG. 5, each section has at least four pairs of parallel top electrodes y and x where y is the row scan electrode and x is the bulk sustain electrode. Although each section of the PDP in FIG. 5 is shown with four pairs of parallel top electrodes y and x, each section may contain more than four pairs. Also the sections are typically without blank spacing between sections as shown in FIG. 5. The blank spacing is used to illustrate that the sections are separate and distinct. Each PDP section in FIG. 5 also has a number of Column Data Electrodes CD, which are connected to Column Data Electronic Circuitry 57. The CD electrodes are the same as the electrodes 12 in FIG. 1. The electrodes x and y are the same as electrodes 18B and 18A, respectively, in FIG. 1.

FIG. 5 shows an embodiment in which y Addressing Circuitry and y Sustainer Circuitry for the Row Scan electrodes y is separately provided for each of the Sections 50A, 50B, 50C, and 50*n*. Addressing Circuitry 66A and y Sustain Section I Circuitry 65A are connected to the Scan Electrodes y of Section 50A.

The x Sustainer Section I Circuitry 61A is connected to the Sustain Electrode x of Section 50A. This address and sustain circuitry is repeated for y and x for Sections 50B, 50C and 50*n*. The y Addressing Circuitry and y Sustain Circuitry of each section works with the x Sustain Circuitry of each section to address and sustain each unique section of the PDP 50. In FIG. 5 this uniquely addressable portion is labeled Section 50A, 50B, 50C, 50*n*, each being comprised of one or more y scan electrode-x sustain electrode pairs. FIG. 5 shows an embodiment in which pairs of y scan electrode-x sustain electrodes of a given section are adjacent to each other on the PDP. This method will also work if scan electrode-sustain electrode pairs of a given section are not adjacent to each other, but are interlaced throughout the display.

ARTIFACT REDUCTION

The PDP industry has used various techniques to reduce motion and visual artifacts in a PDP display.

Pioneer of Tokyo, Japan has disclosed a technique called CLEAR for the reduction of false contour and related problems. See Development of New Driving Method for AC-PDPs by Tokunaga et al of *Pioneer Proceedings of the Sixth International Display Workshops*, IDW 99, pages 787–790, Dec. 1–3, 1999, Sendai, Japan. Also see European Patent Applications EP 1 020 838 A1 by Tokunaga et al of Pioneer. The CLEAR technique uses an algorithm and waveform to provide ordered dither gray scale in small increments with few motion or visual artifacts. CLEAR comprises turning on pixels followed by selective erase.

Fujitsu also discloses the CLEAR technique in combination with ADS U.S. Pat. No. 6,097,358 issued to Hirakasw et al. The CLEAR techniques disclosed in the above Pioneer IDW publication, Pioneer EP 1020838 A1, and Fujitsu U.S. Pat. No. 6,097,358 are incorporated herein by reference.

In the practice of this invention, it is contemplated that SAS may be combined with a CLEAR or like technique as required for the reduction of motion and visual artifacts.

This invention as illustrated herein allows for a larger number of sustain cycles per frame. This allows for a brighter display or alternatively more subfields per display. This also improves the PDP operating margin (window) due to more time allowed for the various overhead functions.

As disclosed herein, this invention is not to be limited to the exact forms shown and described because changes and modifications may be made by one skilled in the art within the scope of the following claims.

What is claimed is:

1. In a method for addressing and sustaining a surface discharge AC plasma display panel, the improvement wherein an addressing voltage is applied to at least one section of the display panel while at least one other section of the panel is being simultaneously sustained, a reset voltage being simultaneously applied to each section of the display panel before an addressing voltage is applied to said at least one section and before said at least one other section is being simultaneously sustained.

2. The invention of claim 9 wherein Section $S_2$ is subsequently addressed while Section $S_1$ is being sustained.

3. The invention of claim 2 wherein there are 12 to 17 subfields.

4. The invention of claim 3 wherein each of the sections $S_1$ and $S_2$ is sustained with a different number of sustains per subfield.

5. The invention of claim 3 wherein each of the sections $S_1$ and $S_2$ is sustained with the same number of sustains per subfield.

6. The invention of claim 9 wherein the resolution of the plasma display is about 480 to about 1200 row scan electrodes.

7. The invention of claim 9 wherein there are 12 to 17 subfields for a resolution up to 768 row scan electrodes.

8. The invention of claim 9 wherein there is used a CLEAR technique for the reduction of motion and visual artifacts, said technique comprising the writing of pixels followed by selective erase.

9. In a method for operating a surface discharge AC plasma display having row scan, bulk sustain, and column data electrodes, the improvement which comprises addressing at least one section $S_1$ of the AC plasma display while simultaneously sustaining at least one other section $S_2$, each section having a predetermined number of bulk sustain electrodes and row scan electrodes, a reset voltage being simultaneously applied to each section $S_1$ and to each section $S_2$ before the simultaneous addressing of each said section $S_1$ and the simultaneous sustaining of each said section $S_2$.

10. An AC plasma display having row scan, bulk sustain, and column data electrodes, said display being divided into a plurality of sections $S_1$, $S_2$, $S_n$, each section having a predetermined number of bulk sustain electrodes and row scan electrodes, and electronic circuitry for simultaneously addressing and sustaining at least two different sections of the AC plasma display and for simultaneously applying a ramp reset voltage to all sections $S_1$, $S_2$, $S_n$, before the simultaneously addressing and sustaining of said at least two different sections.

11. In a system for addressing and sustaining a surface discharge AC plasma display panel, the improvement wherein an addressing voltage is applied to at least one section of the display panel while at least one other section of the panel is being simultaneously sustained, a reset voltage being simultaneously applied to each section of the display panel before an addressing voltage is applied to said at least one section and before said at least one other section is being simultaneously sustained.

12. In a system having electronic circuitry for operating an AC plasma display having row scan, bulk sustain, and column data electrodes, said display being divided into a plurality of sections $S_1$, $S_2$, $S_n$, each section having a predetermined number of bulk sustain electrodes and row scan electrodes, the improvement which comprises electronic circuitry for simultaneously addressing and sustaining at least two different sections of the AC plasma display and for simultaneously applying a reset voltage to each of said sections $S_1$, $S_2$, $S_n$, before said addressing voltage is applied to at least one of said sections and before at least one other said section is being simultaneously sustained.

* * * * *